United States Patent [19]

Alford

[11] Patent Number: 4,741,564

[45] Date of Patent: May 3, 1988

[54] DOUBLE OPENING GATE LATCH

[76] Inventor: Allen W. Alford, 4812 Andrews, Baytown, Tex. 77521

[21] Appl. No.: 906,135

[22] Filed: Sep. 11, 1986

[51] Int. Cl.[4] ..... F05C 11/00

[52] U.S. Cl. ..... 292/285; 292/205; 292/341.17; 292/286

[58] Field of Search ..... 292/285, 286, 341.17, 292/205, 238, 104

[56] References Cited

U.S. PATENT DOCUMENTS

| | | | |
|---|---|---|---|
| 682,657 | 9/1901 | Wirt | 292/285 |
| 728,087 | 5/1903 | Deardorff | 292/54 |
| 1,482,652 | 2/1924 | Klepper | 292/54 |
| 1,508,091 | 9/1924 | Diesel | 292/281 |
| 1,514,114 | 11/1924 | Wakefield | 292/205 X |
| 1,566,662 | 12/1925 | Fairand | 292/281 |
| 1,627,752 | 5/1927 | Small | 292/281 |
| 1,712,792 | 5/1929 | Hansen | 292/240 X |
| 1,719,272 | 7/1929 | Lee | 292/205 X |
| 1,894,913 | 1/1933 | Sadler | 292/205 X |
| 1,992,734 | 2/1935 | Bittorf | 292/285 X |
| 2,102,203 | 12/1937 | Groenewold | 292/205 X |
| 2,198,079 | 4/1940 | Ferris et al. | 292/143 |
| 3,317,230 | 5/1967 | Demrick et al. | 292/281 |
| 3,852,981 | 12/1974 | Koning | 292/205 X |
| 3,988,031 | 10/1976 | Meyer | 292/205 X |
| 4,451,072 | 5/1984 | Petty, Sr. | 292/104 X |

FOREIGN PATENT DOCUMENTS

| | | | |
|---|---|---|---|
| 452783 | 11/1948 | Canada | 292/205 |
| 511966 | 4/1951 | Canada | 292/281 |
| 340391 | 9/1921 | Fed. Rep. of Germany | 292/281 |
| 344984 | 12/1921 | Fed. Rep. of Germany | 292/205 |
| 353985 | 5/1922 | Fed. Rep. of Germany | 292/205 |
| 402456 | 10/1909 | France | 292/285 |

*Primary Examiner*—Gary L. Smith
*Assistant Examiner*—Eric K. Nicholson
*Attorney, Agent, or Firm*—Gunn, Lee & Jackson

[57] ABSTRACT

A double opening gate latch for single and double gates and capable of being unlocked and opened from either side thereof. First and second latch brackets are fixed to opposite ones of a gate and fence assembly or a double gate assembly, the latch brackets being positioned on opposite sides from one another. A latch bar is provided on one side of the gate assembly and is positioned for registry with a latch bracket. A pivotal latch member extends through the gate or fence assembly and includes a part that is pivotal into latching registry with the other latch bracket. The pivotal latch member is positionable in locking and unlocking relationship with the latch bar. The latch apparatus permits the gate to be unlatched from either side thereof and also permits the gate to be securely locked on either or both sides thereof.

13 Claims, 2 Drawing Sheets

DOUBLE OPENING GATE LATCH

FIELD OF THE INVENTION

This invention relates generally to gate latch mechanisms such as are provided for locking and unlocking single or double outdoor gates. More particularly, the present invention is directed to a unique latch mechanism for single and double gate assemblies and which is capable of being unlocked and released from either side thereof.

BACKGROUND OF THE INVENTION

Most homes are provided with fencing systems to enclose all or a portion of the lot on which the home is situated. Where fencing is employed, it may be of the chain link type through which visibility is good or it may be of a solid wood type wherein visibility through the fence is prevented. Fences are obviously provided for security reasons and in many cases are provided to protect children and other persons from any other hazardous environment that may be located on the premises. For example, many domestic facilities are constructed to include swimming pools, exotic gardens and the like, and in many cases contain dogs as pets or guards. Where any kind of hazardous environment is located on the premises, it is desirable to provide a security fence, especially in the case where the back yard of a home contains a swimming pool. Insurance codes and city and county laws often require the swimming pool to be fenced to prevent young children from being attracted to it and gaining unauthorized access to it.

Especially where wooden fences are employed, typically the fences are of sufficient height that one cannot see over them. Obviously, where fences are employed, security gates are also employed. Gates may be of the single type the opposite portion of the fence contains a latch mechanism this is engageable by a corresponding latch device on the gate. In the case of double gates such as are frequently utilized to form a gate closure for driveways, a pair of gates are each pivoted to sections of the fence and are then secured together at the central portion thereof by a latch mechanism. In all cases known at the present time, gate mechanisms that are commercially available are intended to be installed on the gate assembly such that they are accessible from one side only. If the gate and fence are of the solid type and one wishes to pass through the gate from the opposite direction with a single latch on the opposite side, that person cannot unlatch and pass through the gate and thus must pass through the house or around the opposite side of the fence in order to gain access to the latch. It is therefore desirable to provide a latch mechanism that is capable of being unlocked and opened from either side of the gate mechanism. It is also desirable to provide a latch mechanism that is capable of being utilized with both single and double gate assemblies without any significant alteration thereof.

SUMMARY OF THE INVENTION

According to the present invention, a latch mechanism is provided which may be installed on single and double gate assemblies and is capable of being unlocked and opened from either side thereof. The latch mechanism incorporates a pair of latch brackets which are positioned in fixed relationship on opposite ones of the gate and fence or double gate assembly and are also positioned on opposite sides of the fence from one another. Each latch bracket is provided with an eye adapted to receive the U-shaped shackle of a conventional padlock. A locking bar capable of bridging the gap between the gate and fence or between the double gates is adapted to be positioned in locked assembly with one of the latch brackets. The locking bar is also provided with a locking flange having an eye that receives the U-shaped locking member or shackle of a padlock. A pivot latch extends through an elongated opening in the latch bar and also extends through the gate or fence. The pivot latch is provided with a locking ring or other enlargement which in one position prevents unlocking of the pivot latch from the latch bar and, when rotated 90° to alignment with the elongated slot of the latch bar, allows separation of the pivot latch and latch bar. At its opposite end, the pivot latch includes a locking flange having a lock hole for registry with lock hole of the opposite locking flange, thereby permitting the shackle of a padlock to pass through the locking holes and secure the pivot latch against rotational movement. The gate latch mechanism therefore requires two padlocks or other locking devices, one on either side thereof, for securing the gate in latched condition. Upon removal of either of the padlocks or locking devices, the gate assembly is capable of being opened. Thus, the gate assembly may be unlocked and opened from either side thereof.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings:

FIG. 1 is an isometric illustration of a double opening gate latch mechanism constructed in accordance with the present invention. The latch mechanism positioned in locked relationship with a gate and padlocks is shown in broken lines to simplify an understanding of the invention.

FIG. 2 is a partial plan view of the gate latch mechanism of FIG. 1 illustrating the opposed latch brackets thereof.

FIG. 3 is a partial end view of the latch mechanism taken along line 3—3 of FIG. 1.

FIG. 4 is an isometric illustration of the double gate latch apparatus of FIG. 1, showing the elongated locking bar thereof pivoted to its unlocking position.

FIG. 5 is an isometric illustration of the double gate latch mechanism of FIG. 1 with the pivotal gate latch element shown positioned in its unlocking position.

DETAILED DESCRIPTION OF PREFERRED EMBODIMENT

Figure 1:
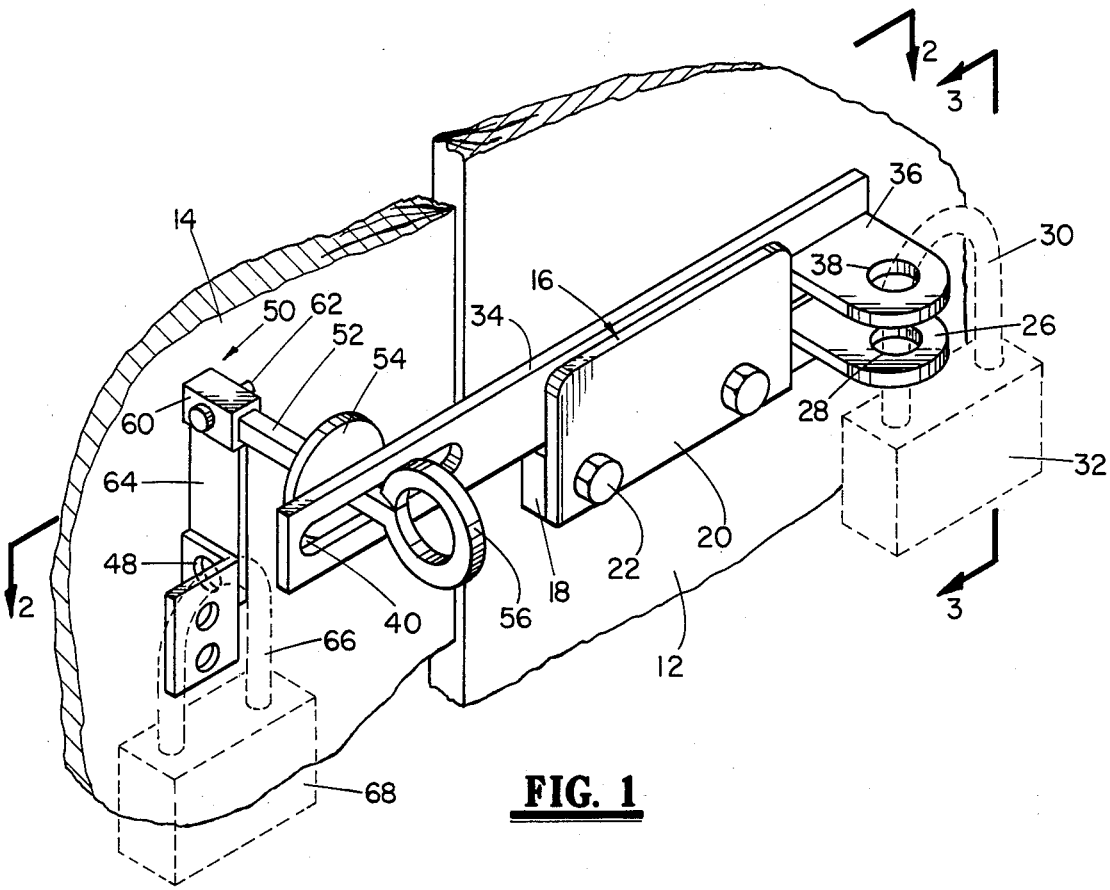
Figure 2:
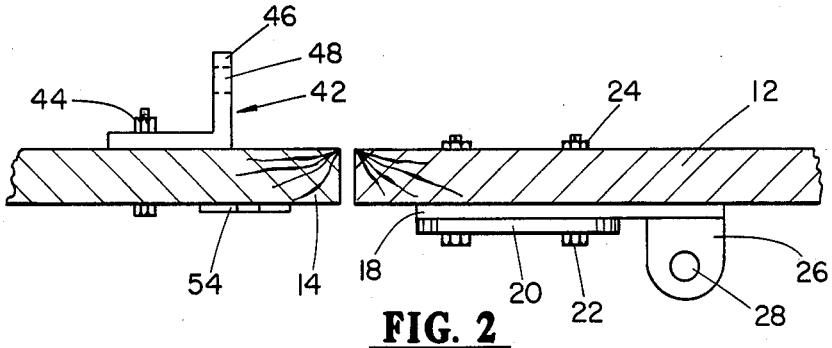
Figure 3:
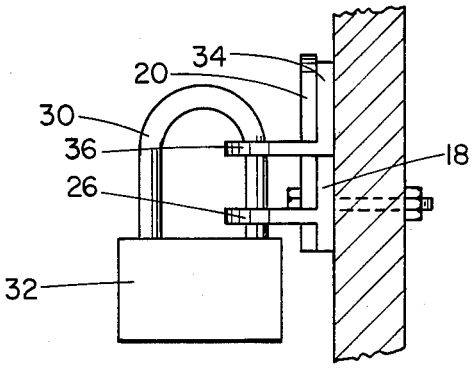

Referring now to the drawings and first to FIGS. 1 through 3, a double opening gate latch mechanism is illustrated generally at 10 which is provided for use with single or double gates of a fence and gate assembly. As shown in FIG. 2, reference numeral 12 may depict a gate or fence while reference numeral 14 may also refer to a gate or fence. The latch mechanism may be positioned in the center of a double gate assembly or may be secured to adjacent sections of a gate and fence for securing the gate in it closed condition. For purposes of discussion it will be assumed that reference numeral 12 is directed to a gate while reference numeral 14 refers to a fence.

To the gate member 12 is secured a first latch bracket which may be of integral construction is desired, or may be of two piece construction as shown. The latch bracket shown generally at 16 includes a bar member 18 which is intended to be positioned against one side of the gate. The bar 18 is drilled to provide a pair of holes through which bolts may pass. A latch plate 20 is provided which is also drilled with holes that match the holes of the bar member 18. Bolts 22 extend through the plate member, the bar member and the gate and are secured in assembly by means of nuts 24, as shown in FIG. 2. At one end of the bar member 18, there is provided a locking flange 26, which is drilled to form a locking hole 28 of appropriate dimension for receiving the shackle 30 of a padlock 32 as shown in broken line and as shown in full line in FIG. 3. The bracket assembly 16 is intended to remain fixed to the gate and is engaged by other moving parts of the latch assembly.

As shown in FIG. 1 and FIG. 3 an elongated latch bar 34 is provided which is of sufficient length to bridge the joint or gap between the gate and fence. The latch bar is not shown in FIG. 2 to simplify an understanding of the structure of bracket 16. At one end of the latch bar is provided a locking flange 36 which, in the position shown in FIG. 1 is disposed in substantially parallel relation with the locking flange 26 of bar member 18. The locking flange 36 defines a locking hole 38 which also receives the shackle of the padlock 32. With the latch mechanism in the position shown in FIG. 1 and with the padlock 32 closed and latched, one end of the double latch mechanism is securely fastened.

At the opposite end of the locking bar 34, the bar is machined to form an elongated opening or slot 40 which receives a pivotal latch member forming a second latching portion of the double latch mechanism. A second latch bracket 42 is secured to the opposite side of the opposite one of the gate and fence assembly. As shown in FIG. 2, the second latch bracket 42 is secured by a bolt and nut assembly 44 to the fence 14. The latch bracket 42 is essentially an L-shaped bracket with one of its flanges secured by the bolt and nut assembly 44 to the fence 14 and providing a latching flange 46 having a locking opening 48 formed therein.

A pivotal latch assembly is provided as shown generally at 50 which incorporates an elongated pivotal shaft 52 of rectangular or at least non-circular cross sectional configuration. The pivotal shaft member 52 extends through the fence 14 and through a retainer washer 54 positioned on one side of the fence 14. At the end of the non-circular shaft 52 is provided an enlargement 56 which may conveniently take the form of a ring formed by simply bending the metal of the shaft 52 to a circular form. The enlargement 56 is in its locking position as shown in FIG. 1, but may be rotated 90° in a counterclockwise direction for alignment with the elongated opening 40 of the locking bar 34. When the enlargement is aligned with the locking opening 40, the enlargement will pass through the elongated opening and thus the locking bar 34 is released and the gate may be opened.

At the opposite extremity of the pivotal shaft 52 is provided a latch member having a head portion 60 defining an internal passage of a configuration receiving the shaft 52 in non-rotatable relation therewith. As shown, the shaft 52 is of rectangular cross-sectional configuration and the passage of head 60 is of mating rectangular cross-sectional configuration. A locking pin 62, a screw or any other locking device may be employed for extending through the head 60 and pivotal shaft 52 to secure the head and shaft in assembly. From the lower side of the locking head 60 extends an elongated flange or hasp 64 having a locking opening formed in its lower position. With the flange or hasp 64 in the position shown in FIG. 1, the shackle 66 of a padlock 68 or any other locking device may be extended through the registering openings of the bracket 42 and the flange or hasp 64 in the manner shown in broken line in FIG. 1. With the padlock secured, the flange or hasp 64 is positively locked in relation to the flange 46 of the latch bracket 42 which thus prevents the pivotal shaft 52 from rotating. The shaft 52 will be maintained in the locked position as shown in FIG. 1 and thus the gate member cannot be opened.

Figure 4:
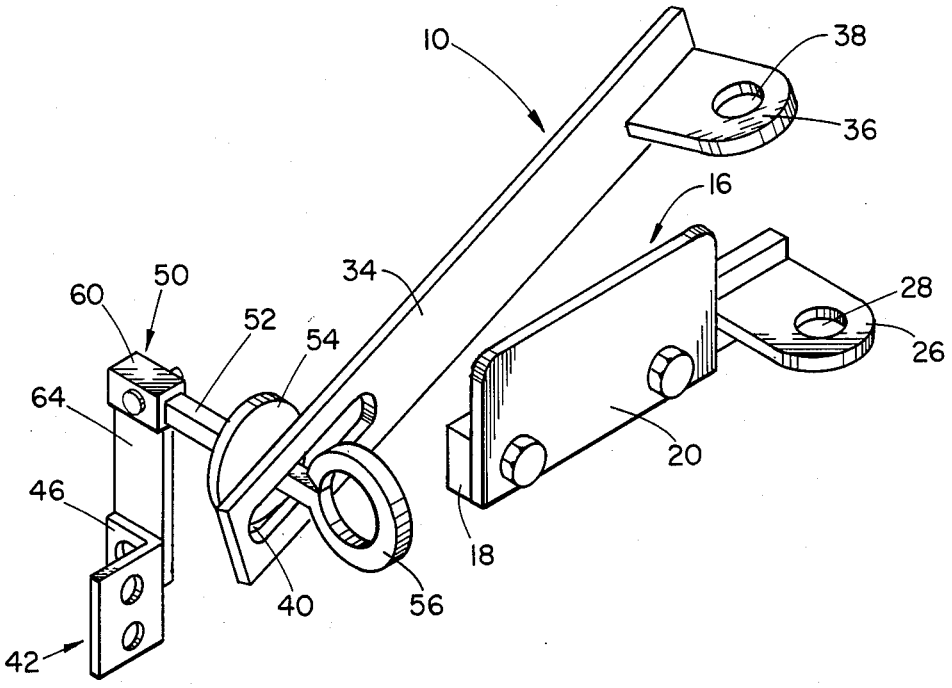
Figure 5:
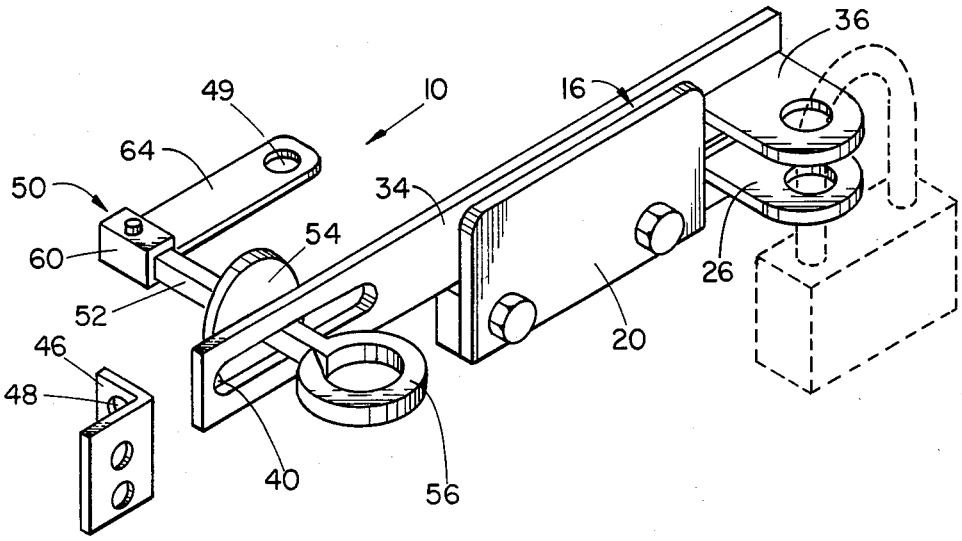

As shown in FIGS. 4 and 5, different unlocked conditions of the double opening gate latch are illustrated. Here again, for purposes of understanding, the gate and fence assembly is not shown. The respective parts, however, are illustrated in the proper relationship thereof as if the gate and fence assembly were present. Also, to facilitate understanding of the invention, the side of the gate and fence assembly on which the bracket assembly 16 is located is referred to as the front side. Conversely, the side of the fence and gate assembly on which the bracket 42 is located is referred to as the rear side or back side. According to FIG. 4, the latch assembly on the front side of the gate and fence assembly is unlocked and the locking bar 34 is pivoted about the shaft 52 to its unlatched position relative to the bracket assembly 16. To accomplish unlocking of the latch assembly from the front side of the gate and fence assembly, the padlock 32, shown in broken lines in FIG. 1 is simply unlocked and the shackle 30 thereof is removed from the holes 28 and 38 in locking flanges 26 and 36. This frees the elongated locking bar 34 for pivotal movement about the pivot shaft 52. During such pivotal movement, the locking bar is pivoted upwardly from its resting relation on the upper surface of bar member 18 and its locking relation between the gate or fence and the upper portion of the locking plate 20. In the position shown in FIG. 4, the gate 12 may be opened from the front side of the gate and fence member. The padlock 68, not shown in FIG. 4, remains securely locked with its shackle extending through registering holes in the flange 46 of the bracket 42 and the depending pivotal flange or plate 64 of the latch assembly 50.

Assuming that a person is approaching the gate and fence assembly from the rear side and intends to pass through it, with conventional gate latch assemblies such cannot be done because the latch cannot be reached and unlocked. The person must then gain access to the front side of the gate in some other fashion in order to unlock the gate and pass through it. According to the present invention, however, as shown in FIG. 5, the person simply unlocks the padlock 68 and removes the shackle from the locking apertures 48 and 49 of flange members 64 and 46, respectively. After the shackle has been removed from holes 48 and 49, the locking flange or plate 64 is free to rotate about 90° along with pivot shaft 52 to the position shown in FIG. 5. In this position the enlargement 56 at the end of the pivot shaft 52 is positioned in registering orientation with the elongated slot 40 of the locking bar 34. In this unlocked position, the gate may be opened. Since the enlargement 56 is aligned with the elongated opening 40, the gate 12 will swing outwardly causing passage of the enlargement 56 through the elongated opening. For closure and locking of the rear side latch assembly, the gate is simply swung to its closed position causing the enlargement to pass through the elongated opening 40, thus bringing the parts to the unlocked position as shown in FIG. 5. The depending flange or plate member 64 is then pivoted downwardly through an arc of about 90° to the position shown in FIGS. 1 and 4, which may be referred to the latched position. The padlock 68 is then replaced with its shackle passing through the locking openings 48 and 49 of flange members 46 and 64.

In view of the foregoing, it is apparent that I have provided a novel double opening latch assembly for single or double gate and fence assemblies. The latch assembly is capable of being secured locked by means of two padlocks or other locking devices located on opposite sides of the gate and fence assembly. The latch assembly may be opened from either side of the gate and fence assembly simply by removing one of the padlocks and pivoting either the locking bar as shown in FIG. 4 or the locking flange or plate 64 along with shaft 52 and enlargement 56 as shown in FIG. 5. This invention is therefore effective to attain all of the objects and features hereinabove set forth, together with other features which will become inherent upon an understanding of the apparatus itself. It is to be borne in mind, however, that the disclosure presented herewith, including the specification and drawings are representative of only a preferred embodiment. This invention may therefore take other convenient forms within the spirit and scope hereof.

What is claimed is:

1. A double opening gate latch mechanism for single and double gates defining relatively movable gate parts and capable of being unlocked and opened from either side thereof, comprising:

(a) first latch bracket means to be fixed to one relatively movable gate part and forming a first locking aperture;

(b) second latch bracket means to be fixed to the opposite relatively movable gate part and forming a second locking flange having a second locking aperture;

(c) first latch means including an elongated locking bar for locking registry with a locking bar receptacle of said first latch bracket means and defining a third locking aperture cooperating with said first locking aperture of said first latch bracket means for receiving a first padlock, said elongated locking bar forming an elongated slot therein; and (d) second latch means including an elongated shaft having a latch forming a latch aperture for registry with said second locking aperture of said second latch bracket means for receiving a second padlock, said elongated shaft forming an enlargement for registry with said elongated slot of said elongated locking bar to permit relative movement of said enlargement through said elongated opening to thus permit opening of said movable gate part, said enlargement also being positionable out of registry with said elongated slot in the locked position thereof thus securing said enlargement and said elongated locking bar in locked assembly and preventing opening of said relatively movable gate part, said second latch means being selectively positionable in locking and release positions relative to said first latch means, at said locking position said first and second latch means are in locked assembly and at said release position said first and second latch means are separable, said first or second latch means being operable to unlock said gate latch mechanism with the opposite one of said first and second padlocks in locking relation with its respective latch bracket assembly.

2. A double opening gate latch mechanism as recited in claim 1, wherein:

(a) said first latch bracket is fixed to one of the front and rear of said relatively movable gate part; and (b) said second latch bracket means is fixed to the other of the front and rear of said relatively movable part.

3. A double opening gate latch mechanism as recited in claim 1, wherein:

(a) said first latch bracket means forms a first locking flange having said first locking aperture formed therein; and (b) said elongated locking bar disposed for pivotal movement into said locking bar receptacle, said elongated locking bar having a second locking flange forming said second locking aperture, said first and second locking apertures being positioned in registry for receiving a padlock therethrough to secure said first and second locking flanges in assembly and thus preventing unlocking movement of said elongated locking bar from said locking bar receptacle.

4. A double opening gate latch mechanism as recited in claim 1, wherein:

(a) said second latch bracket means is an L-shaped bracket being fixed to one side of said opposite relatively movable gate part and forming a fixed locking flange extending away from said gate part and forming said third locking aperture therein; and (b) said elongated shaft of said second latch means being a pivotal latch member having a pivotal locking flange forming a fourth locking aperture, said pivotal third and fourth locking flange being positionable relative to said fixed locking flange to place said locking apertures thereof in registry for receiving a padlock.

5. A double opening gate latch mechanism as recited in claim 4, wherein:

(a) said second latch means is of non-circular cross-sectional configuration having an end portion thereof which is bent to form said enlargement; and (b) said pivotal locking flange is fixed in non-rotatable relation with said elongated shaft.

6. A double opening gate latch mechanism as recited in claim 1, wherein:

(a) said first latch bracket means forms a locking bar receptacle and provides a first locking flange having a locking aperture formed therein; and (b) said elongated locking bar is receivable within said locking bar receptacle in the locked position of said elongated locking bar and forms a second locking flange having said second locking aperture formed therein, at the locked position of said elongated locking bar said locking apertures of said first and second locking flanges being in registry for receiving a padlock to secure said elongated locking bar at its locked position.

7. A double opening gate latch mechanism for single and double gates defining relatively movable gate parts and capable of being unlocked and opened from either side thereof with the opposite side thereof being locked by a padlock or other locking device, comprising:

(a) a first latch bracket to be fixed to one of said relatively movable gate parts, said first latch bracket forming a locking bar receptacle and providing a first locking flange having a locking aperture formed therein;

(b) a second latch bracket to be fixed to the opposite relative movable gate part and on the opposite side from said first latch bracket, said second latch bracket being a generally L-shaped bracket forming a second locking flange having a locking aperture formed therein;

(c) an elongated locking bar forming a third locking flange at one end thereof, said third locking flange defining a locking aperture being disposed in registry with said locking aperture of said first locking flange in the locked position of said locking bar, said locking apertures receiving a first padlock to secure said locking bar in the locked position thereof, said elongated locking bar forming an elongated opening at the opposite end thereof; and (d) second latch means being pivotally movable to a locked position in assembly with said second locking flange and forming a locking aperture for registry with said locking aperture of said second locking flange, in the locked position thereof said locking apertures receiving a second padlock member to secure said second latch means in the locked position thereof, a portion of said second latch means extending through said elongated opening of said elongated locking bar and forming an enlargement capable of moving through said elongated opening in the unlocked position thereof and preventing movement of said enlargement through said elongated opening in the locked position thereof, said elongated locking bar and said second latch means each being capable of unlocking movement with the other of said elongated locking bar and said second latch means secured by a padlock.

8. A double opening gate latch mechanism as recited in claim 7, wherein:

said first latch bracket forms a locking receptacle for said elongated locking bar, said elongated locking bar being pivotally movable about said second latch means during locking and unlocking movement thereof and being receivable within said locking receptacle in the locked position thereof.

9. A double opening gate latch mechanism as recited in claim 7, wherein:

(a) said second latch means is a pivotal latch member having a pivotal locking flange forming a locking aperture, said pivotal locking flange being positionable relative to said fixed locking flange to place said locking apertures thereof in registry for receiving a lock; and (b) said second latch means having an elongated shaft positioned in non-rotatable assembly with said pivotal latch member and forming an enlargement at one end thereof, said enlargement being disposed in alignment with and passing through said elongated locking opening of said locking bar in the unlocked position of said second latch means and being positionable out of registry with said elongated opening of said locking bar in the locked position thereof, maintaining a locked relationship between said locking bar and said second latch means.

10. A double opening gate latch mechanism for single and double gates and capable of being unlocked from either side thereof with the opposite side thereof being locked by a padlock or other locking device, comprising:

(a) a first bracket positionable in fixed relation on one side of a gate and fence assembly and forming a first locking flange having a locking aperture formed therein;

(b) an elongated locking bar having an elongated slot formed thereon, said elongated locking bar capable of being received in locked relation with said first latch bracket and forming a second locking flange at one end thereof having a locking aperture formed therein, in the locked position of said elongated locking bar said locking apertures of said first and second locking flanges being disposed in registry for receiving a padlock member to thus secure the locking flanges and said locking bar in the locked position thereof;

(c) a second latch bracket being fixed to the opposite side of said gate and fence assembly and forming a third locking flange having a locking aperture formed therein;

(d) a pivotal latch member having a locking shaft extending through the opposite one of the gate and fence assembly and having an enlargement at one end thereof extending through said elongated slot of said elongated locking bar, said enlargement being positionable in registry with said elongated slot in the unlocked position thereof to permit passage of said enlargement through said elongated slot to thus allow opening of said gate and fence assembly; and (e) a pivotal locking flange being coupled in non-rotatable relation with pivotal shaft and forming a locking aperture for registering in the locked position thereof with said locking aperture of said third locking flange, at said locked position said locking apertures receiving a padlock member for securing said pivotal flange in the locked position thereof to thus maintain said locking shaft at its locked position maintaining said enlargement thereof out of registry with said elongated opening of said locking bar, either of said elongated locking bar and pivotal latch member being movable to the unlocking positions thereof to open said gates with the opposite one of said elongated locking bar and pivotal latch member secured by a padlock.

11. A double opening gate latch mechanism as recited in claim 10, wherein:

(a) said locking shaft of said second latch means is a shaft of non-circular cross sectional configuration being bent at the free extremity thereof to define said enlargement;

(b) said pivotal flange member forming a non-circular opening receiving said pivotal shaft and said non-rotatable relation therewith; and (c) means securing said pivotal flange and said non-circular shaft in assembly.

12. A double opening gate latch mechanism as recited in claim 11, wherein said second latch bracket comprises:

(a) a spacer bar member having said first locking flange extending outwardly therefrom;

(b) a latch plate being positioned in assembly with said elongated spacer bar with the upper portion thereof being spaced from said gate assembly and defining said locking bar receptacle; and (c) means securing said elongated spacer bar and said latch plate in fixed assembly with said gate assembly.

13. A double opening gate latch mechanism as recited in claim 11, including:

a latch retainer member being received by said non-circular pivotal shaft and forming a retainer aperture of less dimension as compared to the dimension of said enlargement of said non-circular shaft member.

* * * * *